United States Patent [19]

Schnepel

[11] 3,950,028

[45] Apr. 13, 1976

[54] CHAIR

[76] Inventor: Marguerite S. Schnepel, R.F.D. 2, Noxon Road, Poughkeepsie, N.Y. 12603

[22] Filed: Apr. 29, 1975

[21] Appl. No.: 572,920

[52] U.S. Cl. ..... 297/445; 52/753 D; 52/758 H; 297/442; 297/454; 403/231

[51] Int. Cl.[2] ..... A47C 1/12

[58] Field of Search ..... 5/121, 122, 127; 297/440–445, 454; D6/70; 403/170, 171, 231, 217, 219; 52/753 D, 758 H

[56] References Cited

UNITED STATES PATENTS

| | | | |
|---|---|---|---|
| 2,615,505 | 10/1952 | Friedlander | 297/443 |
| 2,731,077 | 1/1956 | Turner | 297/454 X |
| 2,789,626 | 4/1957 | Hagerty | 297/454 X |
| 3,490,809 | 1/1970 | Lange | 297/440 |

*Primary Examiner*—James C. Mitchell
*Attorney, Agent, or Firm*—Clarence A. O'Brien; Harvey B. Jacobson

[57] ABSTRACT

A chair incorporating a basic rectangular frame having vertically spaced front bars and vertically spaced rear bars provided with a durable flexible member, such as a cord, strung in a crisscross fashion so that the intersecting diagonals of the cord form a chair seat. A unique mortise and tenon joint is employed at the intersection of the horizontal upper front bar, a horizontal side bar and a vertical leg at each front corner of the chair to provide a rigid frame and a seat structure which may be easily replaced or repaired in the event of wear with the chair being quite light and easily carried with the front upper bar and the rear upper bar being curved or bent for comfort.

5 Claims, 2 Drawing Figures

CHAIR

BACKGROUND OF THE INVENTION

1. Field of the Invention

The present invention generally relates to a chair and more particularly a chair constructed of a basic rectangular open frame construction having a unique arrangement of a flexible member or cord wound thereabout in a criss-cross fashion so that the intersecting diagonals of the cord extending from front to rear of the chair form the chair seat.

2. Description of the Prior Art

Chairs have been constructed in various arrangements in which interwoven flexible members are provided for forming the chair seat or chair back. In many instances, heavy duty canvas or other flexible material is suspended between a front bar and an upper rear bar to form a combined flexible seat and back rest. Various structures have been provided for supporting canvas elements or other flexible elements from a framework to provide a suspended type of chair seat and back. Also, various types of mortise and tenon joints have been provided in constructing chairs and similar furniture items from wood components. The following U.S. patents illustrate prior developments in this field of endeavor:

| | |
|---|---|
| 69,808 | 10/15/1867 |
| 1,753,487 | 4/ 8/1930 |
| 2,355,957 | 8/15/1944 |
| 2,731,077 | 1/17/1956 |
| Des. 181,870 | 1/ 7/1958 |

SUMMARY OF THE INVENTION

An object of the present invention is to provide a chair of light weight but durable construction incorporating a basic rectangular frame and a flexible cord attached thereto and encircling the frame in such a manner that diagonally extending cords intersect between the front and rear of the frame and define a chair seat.

Another object of the invention is to provide a chair in accordance with the preceding object in which the frame components are interconnected by a unique mortise and tenon joint where three components of the frame intersect.

Still another object of the invention is to provide a chair in accordance with the preceding objects in which the front of the chair is defined by a pair of generally horizontally disposed and vertically spaced bars and the back of the chair is defined by a similar pair of vertically spaced bars with the upper back bar being substantially above the upper front bar with the flexible cord extending diagonally between the front upper bar and rear lower bar and diagonally between the front lower bar and the back upper bar and the cord also being continuous between the front bars and continuous between the rear bars.

Still another object of the present invention is to provide a chair construction employing unique features which may be incorporated into various types of chairs and which in addition to being comfortable and durable provides a chair of unique construction which may be readily repaired in the event of wear of the flexible cord which defines the seat and back rest.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
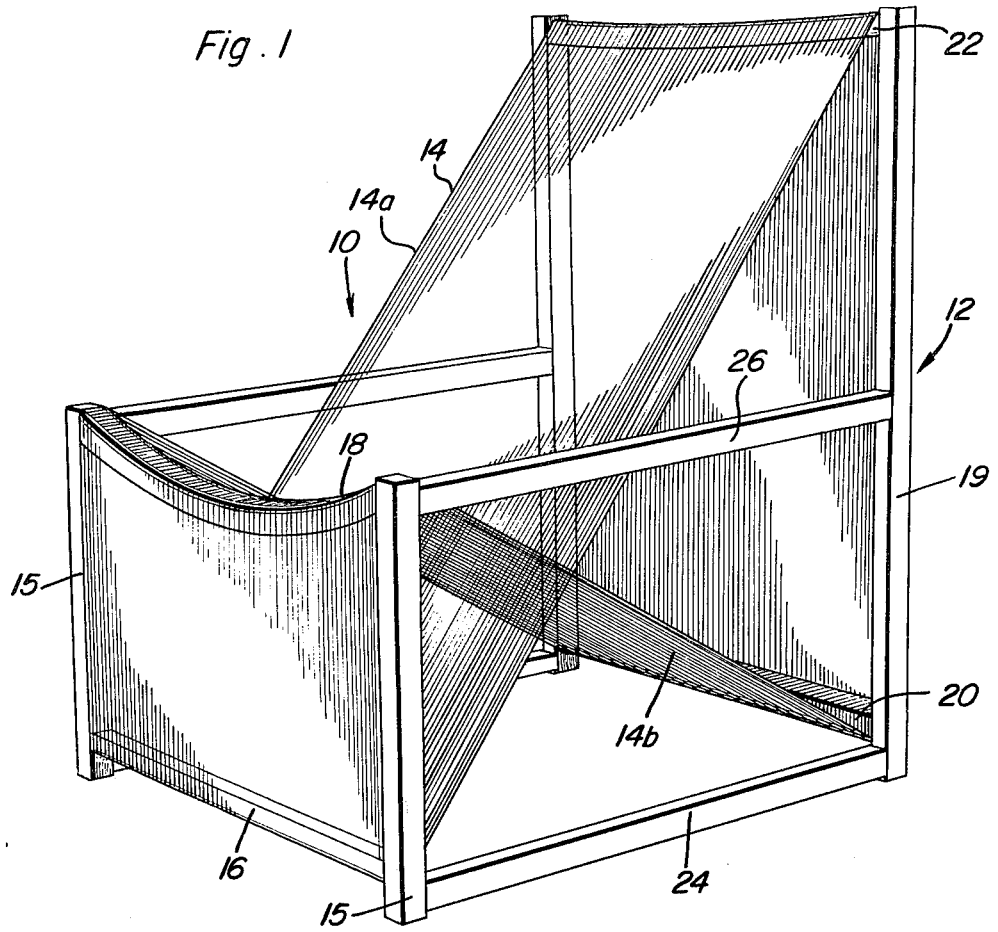
FIG. 1 is a perspective view of the chair of the present invention.

Referring now specifically to the drawings, the chair of the present invention is generally designated by reference numeral 10 and includes a basic rectangular frame 12 and a continuous flexible member or cord 14.

The basic rectangular frame 12 includes a pair of vertically disposed front corner or leg members 15 interconnected by a lower front bar 16 and an upper front bar 18 both of which are generally horizontally disposed and interconnect the inner surfaces of the leg members 15. The rear portion of the frame 12 is defined by a pair of vertically disposed corner members or leg members 19 which parallel the front leg members 15 and are substantially longer than the front leg members 15. The lower ends of the rear leg members 19 are interconnected by a lower rear bar 20 and the upper ends of the rear leg members 19 are interconnected by an upper rear bar 22 which is substantially horizontal and which is arcuately curved rearwardly to contour the chair structure to conform with the body surfaces which may be supported thereby with the upper front bar 18 being downwardly arcuately curved as illustrated. The front leg members 15 and the rear leg members 19 are interconnected by lower side bars 24 and upper side bars 26 which are horizontally disposed and vertically spaced in relation to each other and extending between the bottom ends of the front leg members 15 and the bottom ends of the rear leg members 19 and between the upper ends of the front leg members 15 and an intermediate portion of the rear leg members 19. Thus, an open, generally rectangular frame is defined by the rigidly interconnected components so that the frame is substantially rigid but yet light weight. The frame components may be constructed of wood or any other suitable material.

The flexible cord 14 may be constructed of any suitable material such as natural fiber, plastic material or the like and has one end thereof secured to any of the frame elements by any suitable means so that one end of the cord is anchored. The cord is then strung around the chair frame components in the manner illustrated in FIG. 1 so that the flexible cord will have alternating diagonal components **14*a* and 14*b* extending from the top rear bar 22 under the lower front bar 16 and from the upper surface of the top front bar 18 under the lower rear bar 20 with these cord components also extending vertically between the front bars 16 and 18 and vertically between the rear bars 20 and 22 thus, in effect, closing the front and rear of the chair while leaving the sides of the chair open. The line of intersection between the diagonal cord components 14*a* and 14*b*** defines the chair seat and back rest respectively, both of which are flexible. The cord components are so closely spaced that they will not spread apart due to the tension in the cord, that is, none of the components can move to any substantial degree laterally in view of the straight line condition of the cord components as they extend diagonally and due to the tension formed in the cord. Thus, a single cord is used which is continuously wound around the frame to provide the seat and back rest with the terminal end of the cord being anchored in any suitable manner after the chair has been "strung". In order to repair or replace the cord, it is a simple matter to unwind the cord therefrom or to merely replace a portion of the cord in a well known manner such as by removing a broken cord component and tying a new cord component to the residual ends of the existing cord.

The connections between the frame components where only two components intersect may be in the form of a conventional mortise and tenon joint either glued permanently in position or provided with removable pins or pegs to enable shipment of the furniture item in a knocked down condition thus enabling the customer to enjoy a considerable saving in transportation costs and also enable the customer to assemble the chair after purchase thus rendering the device less expensive to manufacture and deliver to the ultimate consumer. Where three frame components, such as the front corner leg member 15, the upper crossbar 18 and one of the upper side bars 26 intersect, there is a unique connection as illustrated in FIG. 2.

Figure 2:
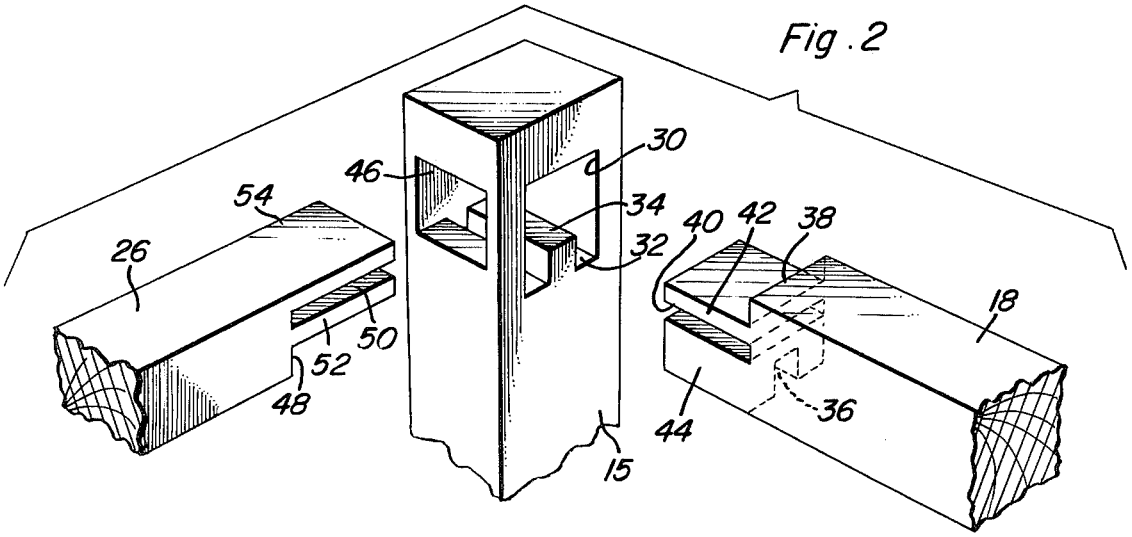
FIG. 2 is an exploded perspective view of the mortise and tenon joint employed at the front upper corners of the chair frame.

The joint or connection illustrated in FIG. 2 includes a laterally extending recess 30 of generally square configuration and which includes a bottom surface 32 provided with an upstanding tongue 34 centrally therein and which parallels the side walls of the recess 30. The recess 30 faces and receives a corresponding end of the front upper bar 18 which includes a longitudinally extending, centrally disposed recess 36 therein corresponding in shape to the tongue 34 and telescopically receiving the tongue 34 when the end of the upper crossbar 18 is moved into the recess 30. The bottom surface of the bar 18 engages the bottom surface 32 and the two side surfaces of the bar 18 engage the two side surfaces of the recess 30 all of which are of planar configuration. The top edge of the bar 18 is provided with a recess 38 extending inwardly from the end thereof and completely across the bar 18. A slotlike recess 40 is also provided in the end of the bar 18 spaced below the recess 38 and in parallel relation thereto thus, in effect, providing a relatively thin axial tongue or tenon 42 and a relatively thick tongue or tenon 44 which is received in the recess 30 or mortise with the length of the tongues 42 and 44 being substantially equal to the length of the recess 30.

The adjacent side of the vertical leg member 15 is provided with an opening 46 which is in communication with the recess 30 and, in effect, forms a mortise for receiving the projecting end of the side bar 26. The side bar 26 includes a transverse recess 48 formed in the bottom surface thereof which extends to the end edge and to both side edges of the side bar 26. Spaced upwardly from the recess 48 is a slot-like recess 50 extending to the end edge of the bar 26 and for the same length as the recess 48 thus defining a lower tongue or tenon 52 and an upper tongue or tenon 54 with the upper surface of the upper tongue 54 being coplanar with the upper surface of the side bar 26. The slot 50 in the side bar 26 is of a height to receive the tongue 42 on the front bar 18. The recess 38 in the front bar 18 is of a size to receive the tongue 54 on the side bar 26 so that the upper surfaces of the side bar 26 and top bar 18 are coplanar when joined together within the mortise. The slot 40 in the front bar 18 is of a dimension to receive the lower tongue 52 on the side bar 26 and the recess 48 on the side bar 26 will receive a portion of the lower tongue 44 so that when the bars 18 and 26 are joined together inside of the recess or mortise, the end edge of the bar 26 will correspond with the far side edge of the bar 18 and the end edge of the bar 18 will correspond with the far side of the bar 26 inasmuch as the inner surfaces of the recess 30 and the intersecting recess 46 are planar in configuration.

This joint provides multiple substantially flat interengaging or contacting surfaces which provides a rigid joint which can be readily assembled by using conventional glue techniques or by using removable fasteners, pins, pegs or the like so that the joint will provide a rigid connection at the point on the chair which receives a substantial portion of the forces imparted thereto during use. This type of joint is especially adapted for use when the frame is constructed of wood components. However, it is within the purview of this invention to use this joint with other types of frame material.

The specific construction of the chair frame and the specific association of the flexible cord therewith provides a sturdy but relatively lightweight and inexpensive chair which can be easily repaired and constructed in various manners, either as a permanently connected structure or as a kit-type of device which may be shipped when in a knocked-down condition and easily assembled by the retail outlet or ultimate customer. The arrangement may also be constructed in the form of a sofa or couch with the placement of the front and back bottom bars adjusting the attitude of the strings and the dimensions of the seat. The device may be constructed into a collapsible chair or a folding chair and the specific size and dimensions of the components including the degree of arcuate curvature of the upper bars may be varied to provide a chair having a high degree of comfort as well as a chair having a unique appearance and construction.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An article of furniture such as a chair, sofa, couch or the like comprising a frame including upper and lower generally horizontally disposed front bars, upper and lower, generally horizontal rear bars with the rear upper bar being disposed above the front upper bar, a flexible cord extending diagonally from the front upper bar downwardly and rearwardly to the rear lower bar and from the upper rear bar forwardly and downwardly to the front lower bar with the diagonals of the cord intersecting along a generally transverse line between the front bars and the rear bars and defining a flexible seat and back rest.

2. The structure as defined in claim 1 wherein said upper front and rear bars are arcuately curved in a manner to conform with an occupant.

3. The structure as defined in claim 1 wherein said pair of front bars are interconnected by front corner leg members, the pair of rear bars being interconnected by a pair of rear corner leg members, and a pair of parallel side members interconnecting the front and rear leg members thus forming a rigid frame.

4. The structure as defined in claim 3 wherein the forward end of the upper side members, the upper end of the forward corner leg members and the outer ends of the upper front bar are interconnected by a mortise and tenon joint in which the overlapping ends of the upper front bar and upper side member are disposed interiorly of a recess defined in the upper end of the forward corner leg member.

5. The structure as defined in claim 4 wherein the overlapping ends of the upper front bar and upper side member have interdigitated slots and tongues, the lower-most surface of the upper front bar including a longitudinal groove therein receiving a longitudinal tongue in the bottom surface of the recess in the upper end of the front leg member.

* * * * *